US008511955B2

(12) United States Patent
Huber et al.

(10) Patent No.: US 8,511,955 B2
(45) Date of Patent: Aug. 20, 2013

(54) SPIRAL BODY LOCK AND METHOD

(75) Inventors: Kirk J. Huber, Magnolia, TX (US); Terry R. Bussear, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 1021 days.

(21) Appl. No.: 12/507,559

(22) Filed: Jul. 22, 2009

(65) Prior Publication Data

US 2011/0016998 A1 Jan. 27, 2011

(51) Int. Cl.
*F16B 39/30* (2006.01)

(52) U.S. Cl.
USPC ..... 411/311; 411/308

(58) Field of Classification Search
USPC ..... 411/308–311; 166/124
See application file for complete search history.

(56) References Cited

U.S. PATENT DOCUMENTS 2,715,441 A * 8/1955 Bouvier ..... 166/127
2006/0012173 A1* 1/2006 Pinckney ..... 285/386

OTHER PUBLICATIONS

W. Sid Scott, "Packers Designed for Coiled Tubing Completions, Recompletions, and Stimulation"; Society of Petroleum Engineers, SPE Paper No. 71056; May 21-23, 2001.

* cited by examiner

*Primary Examiner* — Troy Chambers
*Assistant Examiner* — Terence Boes
(74) *Attorney, Agent, or Firm* — Cantor Colburn LLP

(57) ABSTRACT

A spiral body lock including a mandrel; a sleeve; and at least one of the mandrel and sleeve including a male component, the other of the mandrel and the sleeve including a recess receptive to the male component at least one of the recess and the male component being helically configured and method.

18 Claims, 4 Drawing Sheets

SPIRAL BODY LOCK AND METHOD

BACKGROUND

Common in the downhole drilling and completion arts is the traditional body lock ring. The ring is well known and includes a finely threaded section commonly referred to as "wicker threads" or "wickers" on an inside dimension of the body lock ring that are configured to be engageable with a set of wickers on an outside dimension surface of another component. The body lock ring may be urged along the other component under an applied force to ratchet into a final set position. Because there is a finite distance between adjacent peaks of wicker threads, there is necessarily a potential backlash. In the event that the applied force brings the wickers to very close but not quite the next wicker trough, the device being actuated will relax in backlash by the distance between the wickers. It is possible to reduce backlash by reducing the peak-to-peak distance between adjacent wickers. A reduction in this dimension, however, is often accompanied by a reduction in every tooth dimension including height and flank surface area as well. A reduction in tooth flank surface area tends to reduce the "holding ability" of such flanks. While the backlash is necessarily reduced in this type of construction, the potential for slippage of the body lock so constructed is increased. Since slippage is unquestionably undesirable, wickers with reduced peak-to-peak dimensions are not often the selected solution to the backlash problem.

In some situations the backlash is inconsequential while in others it can be catastrophic to the function of the particular tool or device. For example, if the device is a sealing tool, the backlash may allow sufficient energy in the seal to relax that the seal function is substantially lost. In other devices, while the entire or any substantial part of the functionality may not be lost, it clearly would be better for the ring to retain the input energy than to lose energy. Hence, it is axiomatic that the art would well receive improved apparatus where backlash is reduced or eliminated.

SUMMARY

A spiral body lock including a mandrel; a sleeve; and at least one of the mandrel and sleeve including a male component, the other of the mandrel and the sleeve including a recess receptive to the male component at least one of the recess and the male component being helically configured.

A method for maintaining a set force in a tool including imparting an actuation force to a tool including a spiral body lock; spirally advancing the body lock; and converting axial backlash to spiral movement.

A body lock configured to translate axial movement to helical movement, thereby reducing backlash.

BRIEF DESCRIPTION OF THE DRAWINGS

Referring now to the drawings wherein like elements are numbered alike in the several Figures.

DETAILED DESCRIPTION

Figure 1:
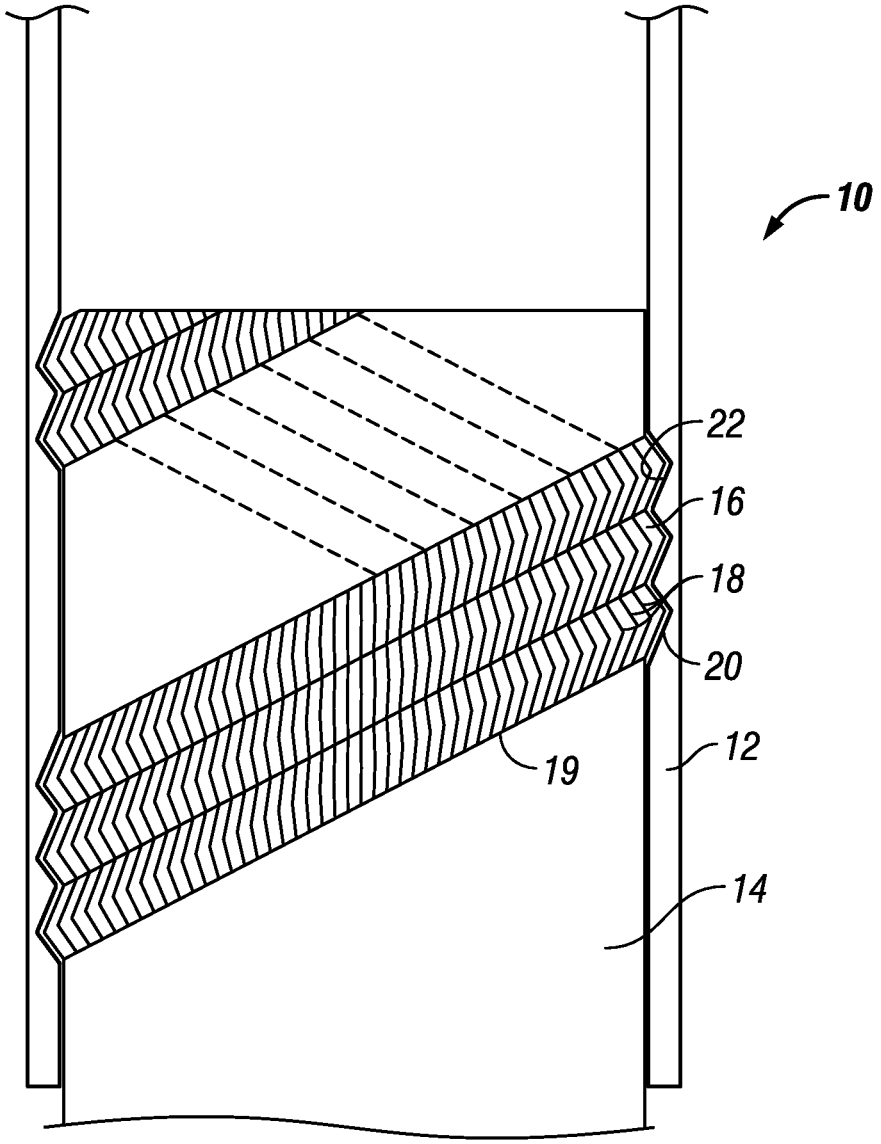
FIG. 1 is a schematic illustration of a first embodiment of a spiral body lock.

Referring to FIG. 1, the spiral body lock 10 is illustrated in a first embodiment. It is to be noted that the terms "spiral" and "helical" are used interchangeably herein and refer to the same shape. The configuration of lock 10 includes a substantially tubular component 12 such as a sleeve and a mandrel 14 disposed therein where one of the tubular component 12 and the mandrel 14 includes a male component 16 having wickers 18 thereon and the other of which includes a recess 20 receptive to or in one embodiment complementary to the male component 16 and having wickers 22 thereon. While "wickers" have been introduced, it is to be understood that "teeth" may also be used interchangeably herein. The terms refer to the same structure. Adjacent wickers 18 are directly connected to each other as shown, with no spacing between base portions 19 of adjacent wickers 18. The male component 16 and recess 20 together work in a spiral manner with at least one of them being spirally formed and the other being operable responsive to the spiral. For example, the male component may be a spirally formed male component akin to a screw thread and the recess may be a relatively short follower or alternatively the male component may be relatively short and the recess be formed as a spiral akin to a nut. These may be reversed also with the male component being on the other of the sleeve and mandrel and the same considerations for embodiments with the length of the spiral and of the recess. In another iteration, the male component and the recess may be of the same length. What should be appreciated is that any length recess and any length male component could be used limited only by practicality.

Because each of the recess 20 and male component 16 include wickers 18 and 22, whether the pitch and length and spacing be the same or different, respectively, movement of one relative to the other can be controlled. The wickers 18 and 22 are in one embodiment unidirectional teeth that facilitate movement of the spiral body lock 10 in one direction while inhibiting movement in the opposite direction. The wickers may also be configured to allow movement in either direction in which case such movement would be based upon a threshold force being achieved in that direction. It should also be noted that the sleeve 12 or the mandrel 14 may be the component rotating and that the rotation may be imparted as rotation input or as axial movement input that is translated to rotational movement by the helical or spiral construction.

Figure 4:
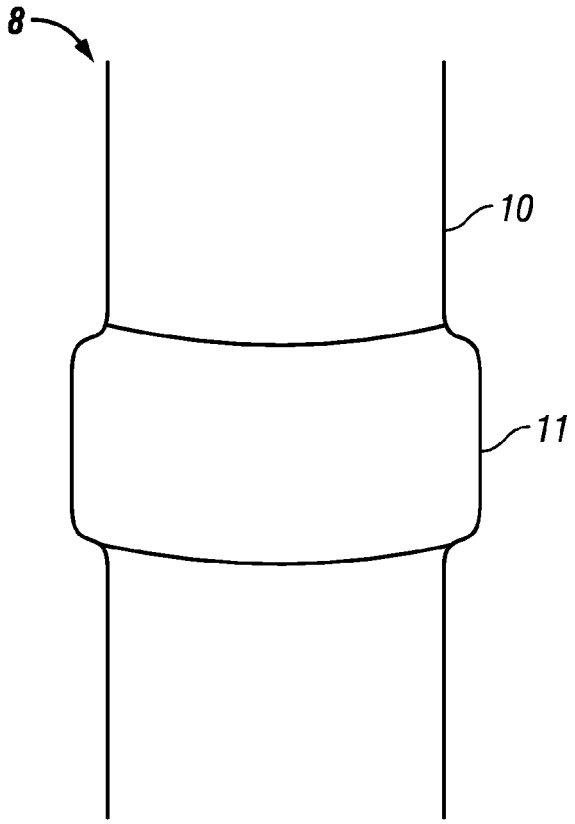
FIG. 4 is a plan view of an exemplary embodiment of a downhole tool including a spiral body lock.

Returning to direction of movement and whether or not that movement is unidirectionally configured, as one of ordinary skill in the art will clearly appreciate one important direction of movement facilitation will be that of setting a tool, in one iteration. For example, where the downhole tool (see FIG. 4) is part of a downhole assembly 8 including the spiral body lock 10, and the downhole tool is a compression set packer 11, the direction of facilitation of movement is the direction that compresses the packer 11 and the opposite direction would be the direction of release of the compressive force on the packer 11. This is similar to the prior art insofar as one direction is for setting and the other for unsetting but as noted above the prior art suffers greatly from the backlash associated with the axial distance between adjacent wicker teeth. With the spiral body lock embodiments, because the teeth are arranged in a spiral pattern, and the spiral body lock 10 operates spirally, the actual distance between adjacent teeth is measured spirally and not axially. The effective axial distance between those teeth is accordingly much smaller than that of the prior art. Because of this condition, the backlash experienced by the system in which the spiral body lock 10 is employed is much smaller than what the prior art could have provided. Another way of visualizing the same thing is to stand a stick with graduations on it vertically and provide a distance value to the graduations measured normal to the surface upon which the stick is standing. Then, support the stick at a 45-degree angle to the same surface and measure the distance to the graduations normal to the surface. The distances have become smaller. Consequently, while the actual distance between graduations or wickers is the same, the vertical or axial distance of movement becomes smaller and accordingly so does the relevant backlash.

In the embodiment of FIG. 1, the male component 16 is configured as three angular bumps on the mandrel 14. It is to be understood that more or fewer could be used and that other geometric configurations could be substituted. It is also noted that the wickers 18 and 22 are shown substantially perpendicular to the direction of the spiral male component 16 but it is not required that they be so. In fact, if the wickers are angled relative to the direction of the male component 16 an even smaller backlash can be achieved. For example, the effective helix angle of the spiral can be made smaller (shallower). By configuring the teeth to lean such that the direction established by a line perpendicular to two adjacent teeth presents an even shallower helix angle relative to an axis of the mandrel 14 then backlash is reduced even further. This property of the system can be advantageously employed when manufacturing a spiral body lock into a tool to adjust the helix angle of the spiral for optimum functionality. Clearly the shallower the helix angle of the spiral, the more rotation is necessary to set the target tool but the lesser the backlash. Hence a tool that is sensitive to backlash would benefit from a shallow helix angle. The tool operator however might prefer a steeper helix angle because setting time would be reduced. This can be likened to a screw with a steeper pitch. The steeper the pitch, the faster the screw goes into the material. The steeper the pitch of the spiral body lock 10 however, the closer it is to the prior art in terms of the backlash produced by the system. If however, the wickers 18 and 22 are leaned relative to an axis of the system even more than the lean of the male component 16 for example, in terms of its helix angle, the backlash can be reduced while still maintaining a relatively quicker set sequence since fewer rotations will be necessary to obtain the same axial displacement while axial distance between wickers is still reduced.

Figure 2:
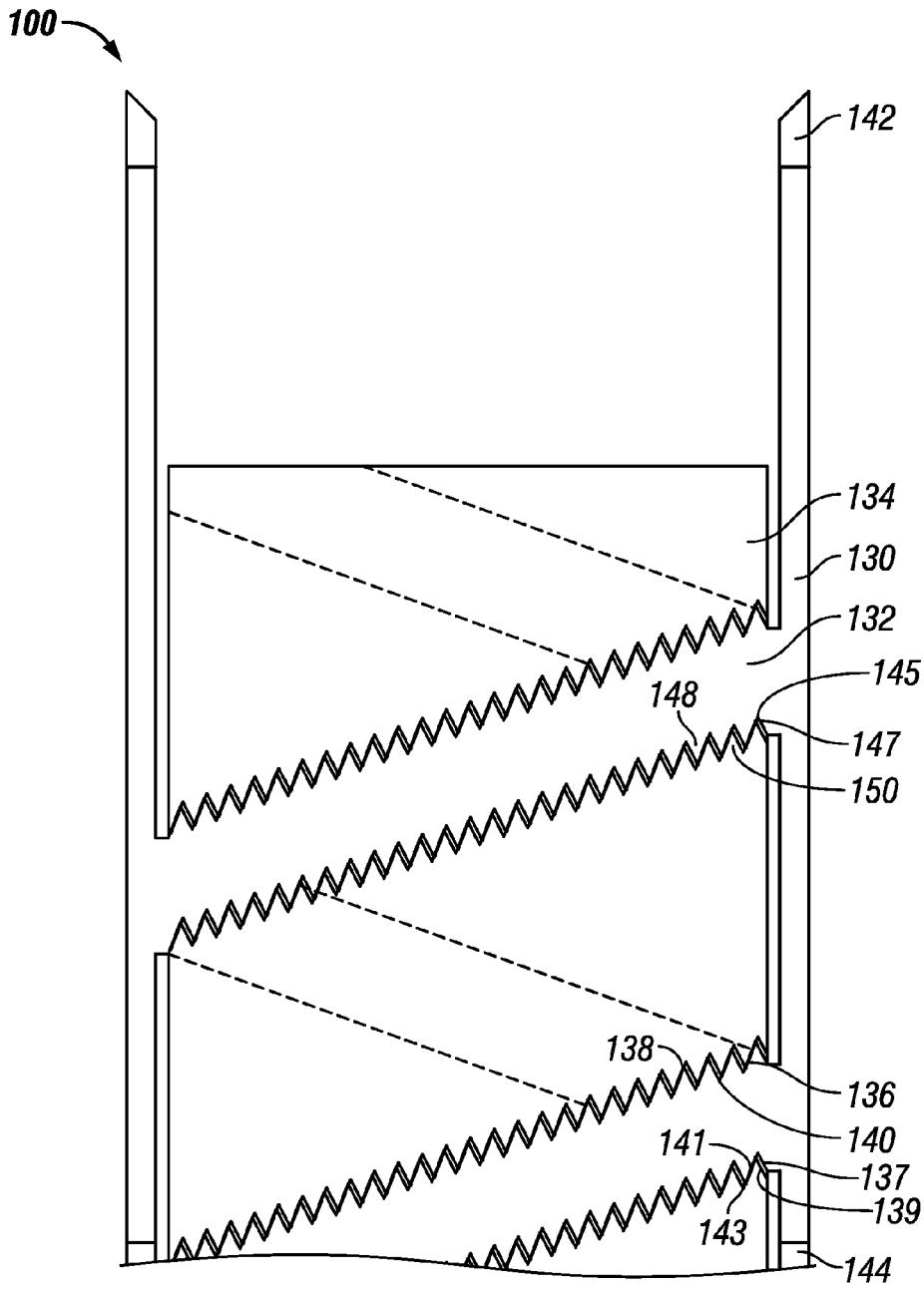
FIG. 2 is a schematic view of an alternative embodiment of the spiral body lock.

In another embodiment, referring to FIG. 2, a sleeve 130 is illustrated supporting a race 132. A mandrel 134 is disposed within the sleeve 130 and includes a groove (recess) 136 therein that will receive and be engagable with the race (male) 132. In one embodiment the groove is directly complementary to the race 132 in that teeth or wickers 138 of the groove 136 will match the teeth or wickers 140 of the race 132 whereas in other embodiments, the teeth 138 will be different than the teeth 140. For example, in one embodiment the ratio of teeth 138 to 140 will be one to three or vice versa. These embodiments will reduce the input force necessary to actuate the device. The triangular-shaped tooth profile of the wickers 138, 140 is clearly shown in FIG. 2, with each wicker 138, 140 having a trailing face 137, 139 and a leading face 141, 143 joining at a peak 145, 147. There is no spacing between adjacent base portions 148, 150 of the wickers 138, 140, and the trailing faces 137, 139 of wicker 138 or 140 is directly connected to the leading face 141, 143 of an adjacent wicker 138 or 140 as shown. Further, in another embodiment, the teeth will have differing pitches. In each case the goal is to reduce backlash to near zero or zero by translating axial movement to radial movement. This improves the overall performance of the tool being set and especially so where the particular tool is susceptible to backlash.

It is to be appreciated that while the illustrated embodiment of FIG. 2 shows the race 132 as a "male" configuration and the groove 136 as a recess these can be reversed with similar operational results.

In each case, the lock 100 may be actuated by an axial load placed on the sleeve or the mandrel depending upon which component is to be moved toward the tool to be set, tooth direction being appropriate for the selection, or may be actuated by a rotational input, the other considerations remaining the same. In the event that the lock 100 will be axially actuated, a bearing 142 at an uphole end of the device and a bearing 144 at a downhole end of the device allow rotational freedom of the components of the device that must follow the helical path. It is to be appreciated that the term "bearing" is used very generically to indicate any configuration that allows rotational freedom. Upon axial (or rotational) actuation of one of the sleeve 130 or mandrel 134, the teeth or wickers are ratcheted past one another and the tool attached to the lock 100 is set. Upon release of the input load, the teeth or wickers hold and prevent unintended unsetting of the tool attached thereto.

Figure 3:
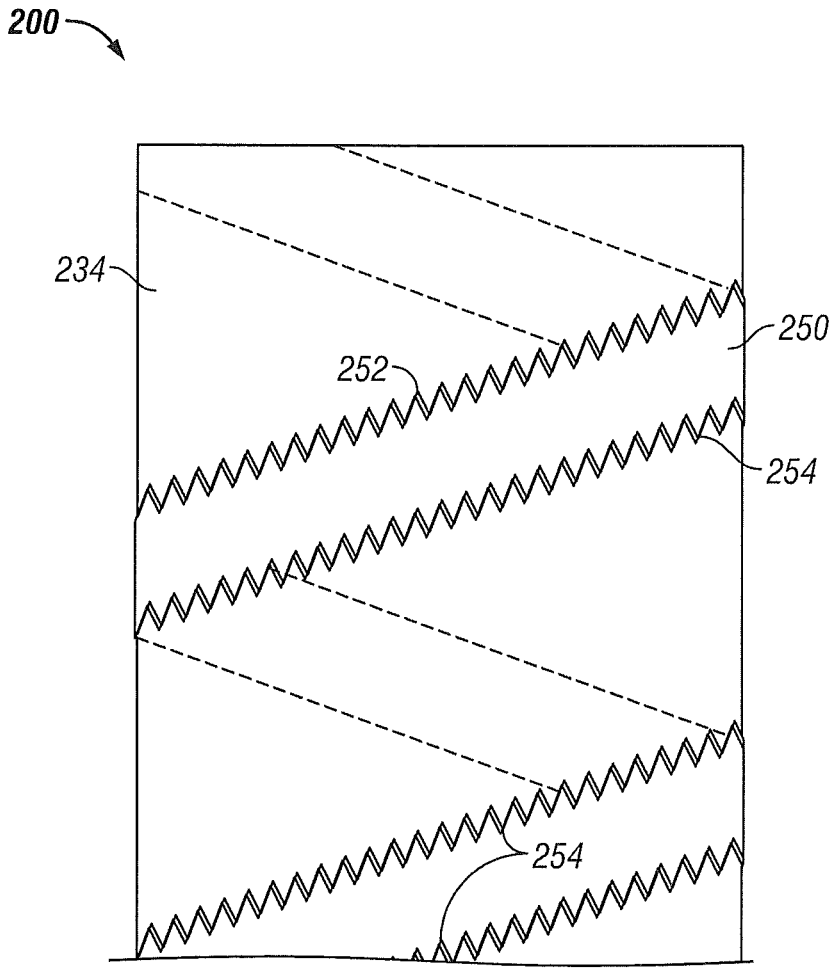
FIG. 3 is a schematic view of another alternate embodiment of the spiral body lock.

In yet another embodiment, referring to FIG. 3, the "sleeve" is configured without the cylindrical portion shown in FIG. 2 but with the race 250 free standing as shown. In the freestanding race 250 embodiment, the race may be constructed from flat stock with teeth/wickers 252, 254 on both lateral edges and then helically wound around a central axis thereby presenting a very cost effective construction. In addition, the embodiment of FIG. 3, allows the race 250 to act as a spring as well thereby adding a spring force to the system and further reducing backlash. This embodiment too may be reversed, with the mandrel being configured as a spiral member and the sleeve being more closely akin to the FIG. 2 embodiment.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A spiral body lock comprising: a mandrel; a sleeve; and at least one of the mandrel and sleeve including a helical male component extending in a helical path, the other of the mandrel and the sleeve including a helical recess receptive to the male component and extending in a helical path, each of the male component and recess including a plurality of wickers, each wicker having a trailing face and a leading face, a trailing face of one wicker directly connected to the leading face of an adjacent wicker in a helical direction within the helical path of each of the male component and recess, wherein the wickers of the male component are configured to ratchet past the wickers of the recess in the helical direction of the helical path of the male component and recess.

2. A spiral body lock as claimed in claim 1 wherein the wickers are directional.

3. A spiral body lock as claimed in claim 1 wherein the mandrel includes the male component.

4. A spiral body lock as claimed in claim 3 wherein the male component has a longitudinal length that is longer than a longitudinal length of the recess.

5. A spiral body lock as claimed in claim 3 wherein the male component has a longitudinal length that is shorter than a longitudinal length of the recess and configured to follow the recess.

6. A spiral body lock as claimed in claim 1 wherein the sleeve includes the male component.

7. A spiral body lock as claimed in claim 6 wherein the male component has a longitudinal length that is longer than a longitudinal length of the recess.

8. A spiral body lock as claimed in claim 6 wherein the male component has a longitudinal length that is shorter than a longitudinal length of the recess and configured to follow the recess.

9. A spiral body lock as claimed in claim 1 wherein the sleeve is a tubular component with a helix configured therein.

10. A spiral body lock as claimed in claim 1 wherein the sleeve is configured as an open helix.

11. A spiral body lock as claimed in claim 10 wherein the helix comprises flat stock helically wound about an axis.

12. A spiral body lock as claimed in claim 1 wherein the wickers are positioned at an angle other than perpendicular relative to the helical direction of the helical path of the male component and the helical direction of the helical path of the recess.

13. A method for maintaining a set force in a tool comprising:

imparting an actuation force to a tool including a spiral body lock as claimed in claim 1;

spirally advancing the body lock; and converting axial backlash to spiral movement.

14. A method as claimed in claim 13 wherein the imparting is rotational.

15. A method as claimed in claim 13 wherein the imparting is axial.

16. A spiral body lock as claimed in claim 1 wherein the spiral body lock is configured to translate axial movement to helical movement, thereby substantially preventing backlash.

17. A spiral body lock as claimed in claim 1 wherein the wickers are helically arranged and directly connected to each other to substantially reduce backlash as compared to a body lock having axially configured wickers.

18. A downhole assembly comprising:

a downhole tool including a compression set packer; and, a spiral body lock as claimed in claim 1, the spiral body lock arranged to set the downhole tool.

* * * * *